United States Patent [19]

Yoshimoto

[11] Patent Number: 5,030,023

[45] Date of Patent: Jul. 9, 1991

[54] PRINTING DEVICE WITH IMPROVED BOLD FACE PRINTING CAPABILITY

[75] Inventor: Satoshi Yoshimoto, Komaki, Japan

[73] Assignee: Brother Kogyo Kabushiki Kaisha, Nagoya, Japan

[21] Appl. No.: 449,475

[22] Filed: Dec. 11, 1989

Related U.S. Application Data

[63] Continuation of Ser. No. 189,306, May 2, 1988, abandoned.

[30] Foreign Application Priority Data

May 7, 1987 [JP] Japan ..... 62-111794

[51] Int. Cl.[5] ..... B41J 2/23

[52] U.S. Cl. ..... 400/210; 400/157.1; 400/61; 101/93.48

[58] Field of Search ..... 400/157.1, 210, 303, 400/304; 101/93.09, 93.48

[56] References Cited

U.S. PATENT DOCUMENTS

| | | | |
|---|---|---|---|
| 4,320,980 | 4/1982 | Mia et al. | 400/210 |
| 4,324,497 | 4/1982 | Gabor | 400/157.1 X |
| 4,388,005 | 6/1983 | Wehking et al. | 400/697 |
| 4,427,312 | 1/1984 | Ovllemmaya | 400/157.1 X |
| 4,688,956 | 8/1987 | Miyake | 400/210 |
| 4,692,095 | 9/1987 | Mahita | 400/210 X |
| 4,708,805 | 11/1987 | Tsumuna et al. | 410/697.1 |
| 4,750,102 | 7/1988 | Onoda | 400/304 |

FOREIGN PATENT DOCUMENTS

| | | | |
|---|---|---|---|
| 63675 | 5/1981 | Japan | 400/304 |
| 147376 | 8/1985 | Japan | 400/697 |
| 198281 | 10/1985 | Japan | 400/697 |
| 198282 | 10/1985 | Japan | 400/697 |
| 146543 | 4/1986 | Japan | 400/304 |
| 191154 | 8/1987 | Japan | 400/210 |
| 198279 | 10/1989 | Japan | 400/697.1 |
| 253577 | 12/1989 | Japan | 400/697 |

OTHER PUBLICATIONS

IBM Technical Disclosure Bulletin, "Offset Print Hammer", Bagaczyk, Bonafino, Dessel, Gilbert, vol. 17, No. 5; Oct. 1974, p. 1317.

*Primary Examiner*—Edgar S. Burr
*Assistant Examiner*—Joseph R. Keating
*Attorney, Agent, or Firm*—Kane, Dalsimer, Sullivan, Kurucz, Levy, Eisele and Richard

[57] ABSTRACT

Disclosed is a printing device such as an electronic typewriter and a wire-dot type printer. With the disclosed printing device, control means is operated in response to depression of a character key, on condition that a bold-face print mode is being set on, to print a character designated by the character key at different three or more print positions, including a first print position, a second print position spaced apart from the first print position along the print line so that a second dint formed in the second print position is not overlapped with a first dint formed in the first print position, and a third print position located between the first and second print positions to form a third dint to fulfil a un-printed area of the print sheet remaining between the first and second dints.

4 Claims, 5 Drawing Sheets

PRIOR ART

PRINTING DEVICE WITH IMPROVED BOLD FACE PRINTING CAPABILITY

This is a continuation of co-pending application Ser. No. 189,306 filed on May 2, 1988, abandoned.

BACKGROUND OF THE INVENTION

With the prior art printers such as electronic typewriters, a bold-faced character may be printed by operation of a bold command key provided on a keyboard so that a central processing unit (CPU) produces a bold-face printing mode, in which a selected one of character keys is then operated to print a corresponding character in a bold-faced type.

More particularly, as shown in FIG. 7, a type element 1 of the selected character is struck by a print hammer in a first print position Pa to set the first print on a print sheet 3 via a print ribbon 2. Then, the print head is moved laterally along the print line to a second print position Pb which is spaced a distance from the first print position Pa so that the type element 1 overlaps a part of the character printed, and in which the second print is set. Likewise, the print head is again moved to a third print position Pc in which the third print is made to print the same character in an overlapping manner. Thus, the character is printed in a bold-face type. With an electronic typewriter capable of bidirectional printing, such three steps may be proceeded in the order opposite to that described above.

In such bold-face character printing operation with the prior art typewriters, the type element 1 makes a dint 6 in the print sheet 3 at the first print position Pa. When the type element 1 strikes the print sheet 3 in the second and third print position Pb and Pc, its front right side of the type element 1 is first brought into contact with a non-printed area of the print sheet 3 while at this time the front left side is in no contact with the print sheet 3 due to the dint 6 which has been formed in the first printing. The type element 1 will therefore tend to tilt in an arrow-indicated direction. This tendency will become much significant, when a center of gravity of the type element 1 is preset to be biased to the left with respect to the print sheet 3 for better printing quality.

Consequently, the impact of the type element 1 against the print sheet 3 is weakened at its right side, resulting in non-uniform ink setting or smudging at the rIght side of the bold-faced character 5 thus printed, as shown in FIG. 9.

SUMMARY OF THE INVENTION

It is therefore an object of the invention to provide a printing device capable of printing bold-faced characters with a fine print quality and free from smudging.

To achieve this objects according to the invention, there is provided a printing device comprising input means for inputting character data; print mode changing means for changing print modes between a normal print mode for printing a character in its original type and a bold-face print mode for printing a character in a bold-face type; print head for printing characters on a print sheet in response to the character data; print head driving means for reciprocating the print head along a print line on the print sheet; and control means for controlling the print head driving means such that, when the bold-face print mode is designated by the print mode changing means, a specific character designated by the input means is printed by the print head at least three times at different print positions standing along the print line, the different print positions including a first print position, a second print position located apart from the first print position so that a second dint formed in the second print position is not overlapped with a first dint formed in the first print position, and a third print position located between the first and second print positions to form a third dint to fill a unprinted area of the print sheet remaining between the first and second dints.

With the above constructed printing device, a bold-faced character can be printed with fine print quality, without being smudged.

BRIEF DESCRIPTION OF THE ACCOMPANYING DRAWINGS

These and other objects as well as characteristic features of the invention will be understood from the following description of the embodiment when read in conjunction with the accompanying drawings in which, FIG. 1 is a plan view of an electronic typewriter embodying the invention;

DESCRIPTION OF THE EMBODIMENT

Figure 1:
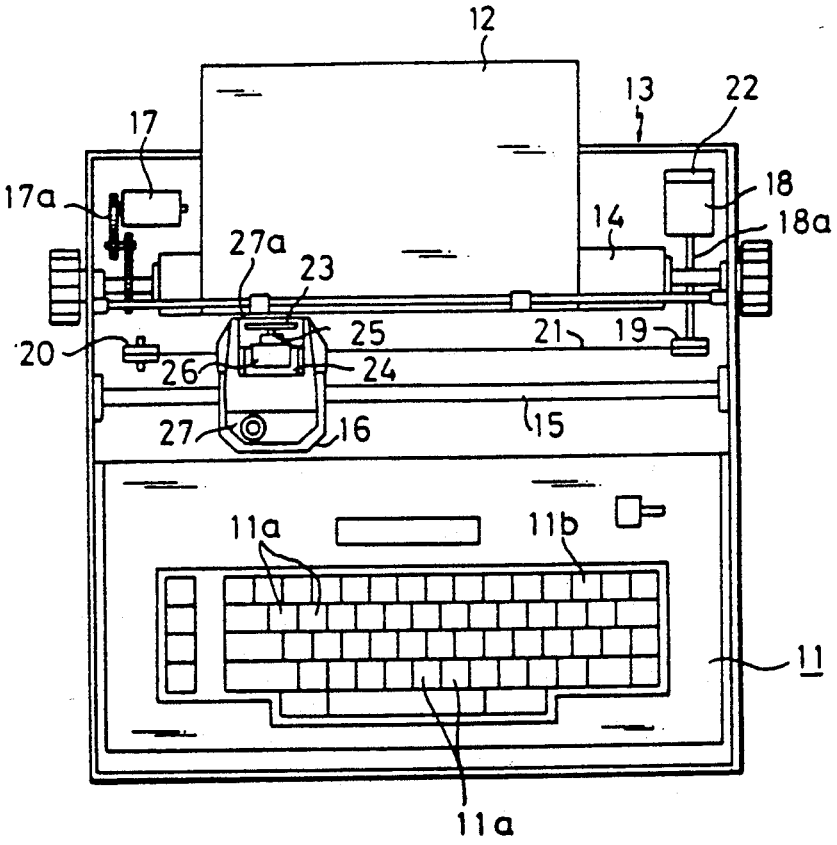

With reference to FIG. 1, an electronic typewriter embodying the invention comprises in general a keyboard furnished with a plurality of operating keys including character (this term is herein used to include symbols as well) keys 11*a* and a bold-face print key 11*b*, and a printer 13 operated in response to charater data inputted by depression of the character keys 11*a* to print characters on a print sheet 12.

A platen 14 for supporting and feeding the print sheet 12 is bridged over the printer 13. A carriage 16 is reciprocally supported by a guide shaft 15 and a guide rail (not shown) extending parallel with the platen 14. The platen 14 may be rotated in opposite directions by a line feed motor (LF motor) consisting of a step motor 17 via a gear mechanism 17*a* to feed the print sheet 12 in forward and backward directions.

Opposed to the LF motor 17 is mounted a carriage drive step motor (CA motor) 18 having a drive shaft 18*a* connected to one 19 of a pair of pulleys 19 and 20. These pulleys are connected by an endless wire 21 extending in parallel with the platen 14 and guide shaft 15 therebetween, and having a definite portion in engagement with the carriage 16. Thus, the carriage 16 is moved forward to the right by the CA motor 18 rotating in forward direction, while it is moved backward to the left when the CA motor 18 rotates in reverse, both along the guide shaft 15. The CA motor 18 is equipped with an encoder 22 to detect the angular position of the motor 18.

The carriage 16 has mounted thereon a print head including a daisy wheel 23 having a plurality of type elements **23*b* (FIG. 3) attached to the respective tip ends of radially extending spokes 23*a*, a type-wheel select motor (WH motor) 24 for rotating the daisy wheel 23 to set a desired one of the type elements 23*b* to a print position, a print hammer 25 for striking the selected type element 23*b*, a print hammer solenoid 26 for driving the print hammer 25, and a ribbon cassette 27 housing a print ribbon 27*a*. The print head is operated to print characters on the print sheet 12** in a known manner.

Figure 3:
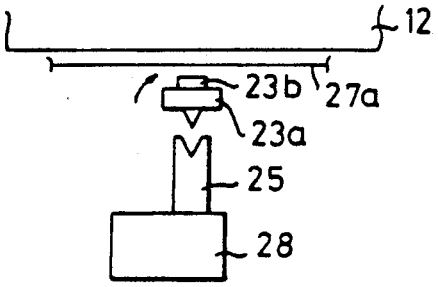
FIG. 3 is a plan view illustrating arrangements of a print head of the typewriter, particularly explanatorily showing positional relationship between a type element and a print hammer of the print head.

The print hammer 25 is, as shown in FIG. 3, provided at its base portion with a hammer weight 28 which is biased to the left, so that the center of gravity of the print hammer 25 is somewhat shifted to the left for better printing quality. Thus, when a certain type element **23*b* residing in the print position is hammered by the print hammer 25, a moment in an arrow-indicated direction is imparted to the type element 23*b*, whereupon the left part of the type element 23*b* as viewed in FIG. 3 as viewed from the print sheet 12 will give the print sheet 12 a greater amount of ink transfer from the print ribbon 27*a*** than its right part.

Figure 2:
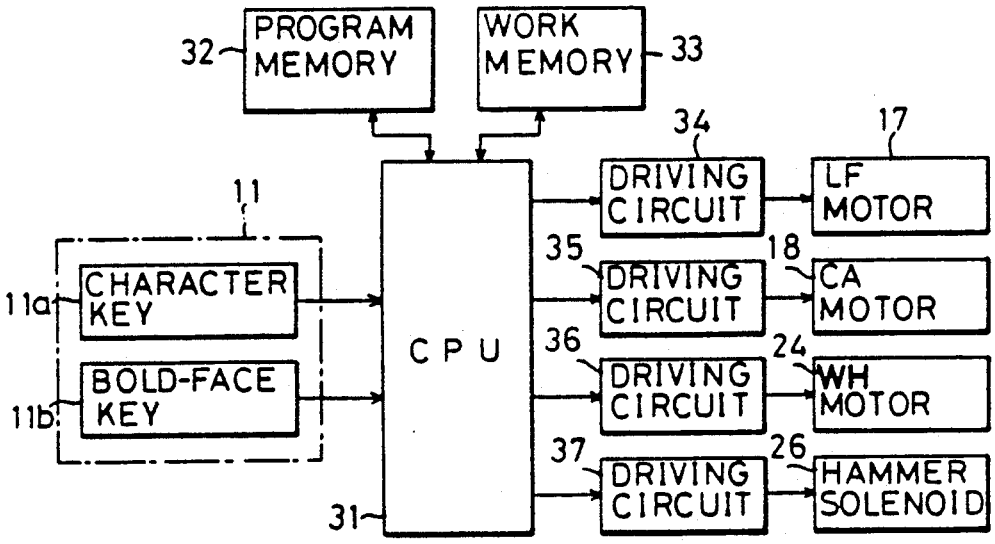
FIG. 2 is a block diagram of electric construction of the typewriter.

Now the electric arrangements of the electronic typewriter as above constructed will be described below with reference to a block diagram shown in FIG. 2.

To control means which comprises in this embodiment a central processing unit (CPU) 31 is connected a program memory 32 storing control program, and a work memory 33 for temporarily storing the operation results of CPU 31 and the character data inputted by operation of the keys **11*a*. CPU 31 controls processings for printing operation with the control program stored in the program memory 32** in accordance with various data entered.

CPU 31 is connected to the LF motor 17 and CA motor 18 via drive circuits 34 and 35 respectively, which are operated in response to drive control signals outputted from CPU 31 to drive the motor 17, 18 in forward or backward direction. CPU 31 also outputs a drive control signal to a drive circuit 36 for controlling the forward and backward rotation of WH motor 24. CPU 31 is further connected to the hammer solenoid 26 via a drive circuit 37 to send a drive control signal to the circuit 37 for energizing the solenoid 26.

Figure 4:
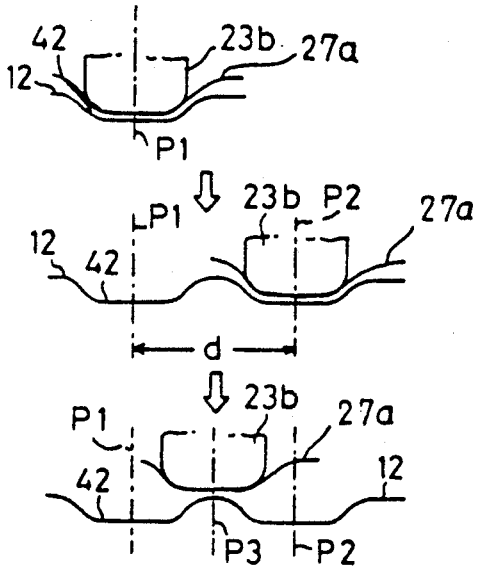
FIGS. 4 and 5 are explanatory views showing a manner in which a bold-faced character is printed on a print sheet with the typewriter, in which FIG. 4 specifically shows relative positions of the type element and the print sheet and FIG. 5 specifically shows the order of formation of the bold-faced character "I"
Figure 5:
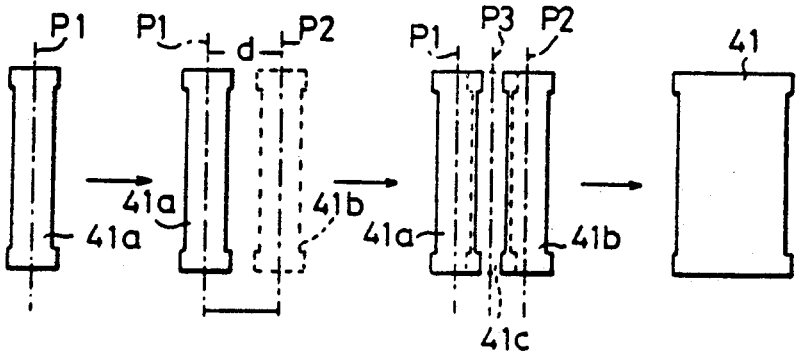

CPU 31 will also change the print mode in accordance with operation of functional keys. Especially, when the bold-face print key **11*b* is depressed to set the bold-face print mode, the print head become ready to print a desired character in a bold-face type in response to operation of the corresponding character key 11*a* in such manner as shown in FIGS. 4 and 5. More particularly, with the bold-face print mode of CPU 31, the character 41*a* is first printed on the print sheet 12 by the type element 23*a* positioned in a first print position $P_1$, and the type element 23*a* is then moved along the print line to a second print position $P_2$ which is spaced apart from the first print position $P_1$ a distance (d) sufficient to allow the same character 41*b* to be printed on the print sheet 12 not overlapping the previously printed character 41*a*. In other words, the type element 23*a* in the second print position $P_2$ should not lie over a dent 42 formed by the type element 23*a* in the first print position $P_1$. Then, the type element 23*a* is moved back to a third print position $P_3$ located in the middle of the first and second print positions $P_1$ and $P_2$, at which position $P_3$ the character 41*c* is printed to thereby form a bold-faced character 41**. In a preferred example, the distance (d) of 1/120 inches brings a favorable result.

Figure 6:
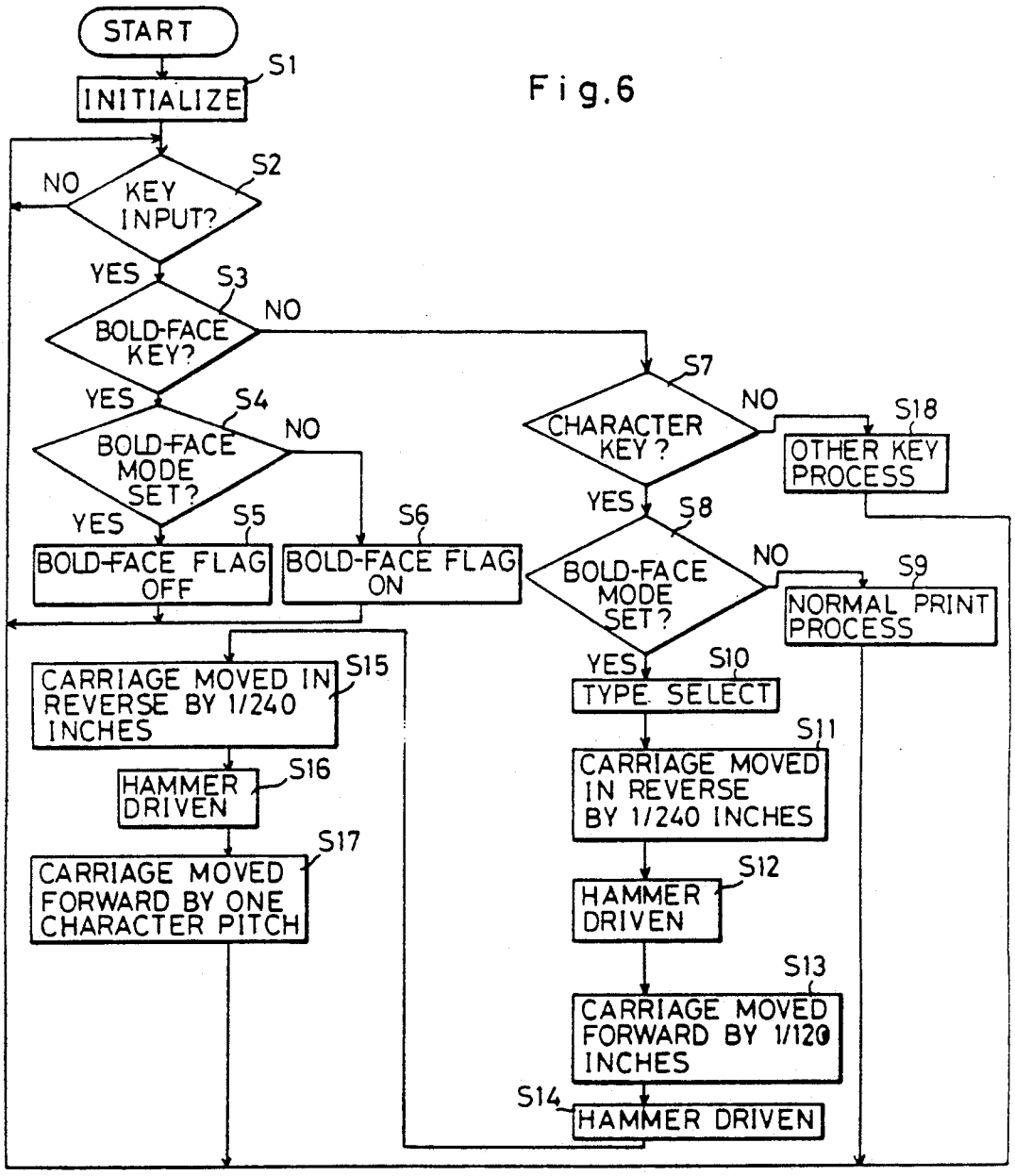
FIG. 6 is a flow chart showing operations of CPU, including control procedures for printing bold-faced characters.
Figure 9:
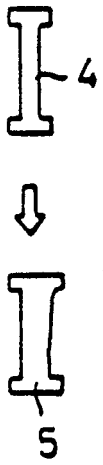
FIG. 9 shows an example of the bold-faced character printed with the prior art typewriter, the right side being smudged.
Figure 8:
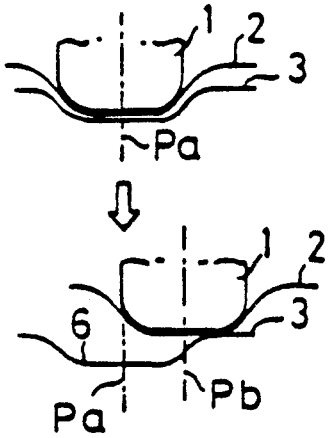
PRIOR ART Fig.8
FIGS. 7 and 8 are explanatory views showing a manner in which a bold-faced character is printed with the prior art typewriter.
Figure 7:
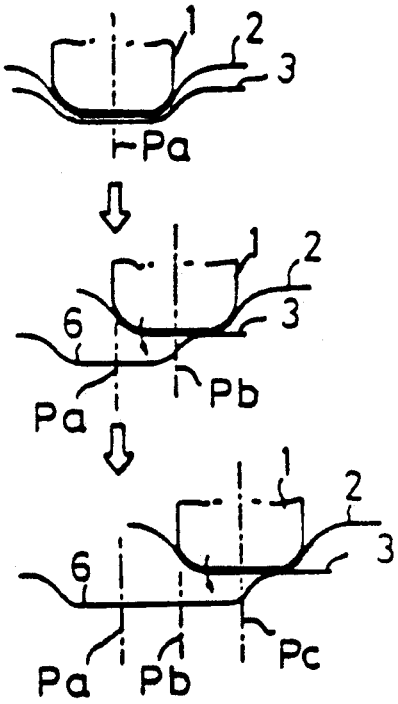
PRIOR ART Fig.7

Now description will be given on the bold-face print control with the electronic typewriter as above described, while referring specifically to a flow chart of FIG. 6.

When power is supplied to the typewriter, such control is started with its procedure advancing to step S1 (hereinafter referred to simply as S1, as for all other steps) for initialization, including cancellation of a bold-face flag retained in the work memory 33. Next in S2 a key input is waited. Upon depression of any key, a decision is made in S3 as to whether the key input is from the bold-face key **11*b*. If so, the next S4 discriminates in accordance with the bold-face flag as to whether the bold-face print mode is now on. With the bold-face print mode effected, the control procedure advances to S5 for turning off the bold-face flag to clear the bold-face print mode. If, in turn, S4 discriminates that the bold-face print mode is now not entered, the bold-face flag is turned on in S6 to change the print mode to the bold-face print mode so that the typewriter become ready for printing bold-faced characters. The procedure returns to S2 from S5 or S6**.

Meanwhile, when the result of decision in S3 is No, the procedure advances to S7 for determining whether the key operated is one of the character key. With the character key operated, next in S8, a decision is made as to whether the bold-face print mode is now set in accordance with the bold-face flag. When the result in S8 is No, the procedure advances to S9 for normal printing operation and then returns to S2. More particularly, in S9, CPU 31 commands that the type element **23*b* selected by the character key 11*a* operated be located in opposition to the print hammer 25 by means of WH motor 24, the print hammer 25 then moved toward the platen 14 by means of the hammer solenoid 26 to cause the type element 23*b* to strike the print sheet 12 via the print ribbon 27*a*, and thereafter the carriage 16 moved one character ahead along the print line by means of CA motor 18**.

In case the bold-face print mode is set on, the procedure advances to S10 wherein the type element **23*b* corresponding to the character key 11*a* operated is located in opposition to the print hammer 25 by means of WH motor 24. Next in S11, CPU 31 commands that CA motor 18 be step-driven in reverse to return the carriage 16 by 1/240 inches, that is half a distance (d) so that the type element 23*b* is positioned in the first print position $P_1$. The procedure advances to S12 where the hammer solenoid 26 is driven and thus the type element 23*b*** *is* hammered by the print hammer 25 to print the selected character in the first print position $P_1$ on the print sheet 12. Then in S13, the CA motor 18 is step-driven to moved forward the carriage 16 by the distance (d), 1/120 inches, so that the type element **23*b* is now positioned in the second print position $P_2$, in which the second printing of the selected character is carried out in S14 in the same manner as in the first printing in S12 As shown in FIG. 5, the characters 41*a* and 41*b* printed in the first and second print position $P_1$ and $P_2$ are entirely separated from each other to provide therebetween a small gap. Next, in S15, the carriage 16 is again moved in reverse by half a distance (d) or 1/240 inches so that the type element 23***b* is positioned in the third print position $P_3$ located just in the middle of the first and second print positions $P_1$ and $P_2$, and then in S16 the third printing 41*c* of the selected character is carried out to fill the gap formed between the first and second printed characters 41*a* and 41*b*, thereby forming a bold-faced character 41. After driving CA motor 18 in forward direction to move the carriage 16 one character ahead to a position ready for the next printing operation in S17, the procedure returns to S2.

If, in the meantime, the result of decision in S7 is No, meaning that any key other than the bold-face key 11*b* and the character keys 11 is operated, corresponding key operation is performed in S18 and then the procedure returns to S2.

With the embodiment described above, in printing operation of a bold-faced character, the selected character is printed in the second print position $P_2$ as 41*b* which does not overlap the character 41*a* printed in the first print position $P_1$. Therefore, when the type element 23*b* strikes the print sheet 12 in the second print position $P_2$, it impacts against an area of the print sheet 12 apart from the dent 42 formed by the first printing in the first print position $P_1$, and thus there will arise no tendency that the type element 23*b* in the second print position may tilt in the counterclockwise direction as in the prior art arrangement. As a result, even if the print hammer 25 has its center of gravity biased to the left for better ink transfer and finer printing quality, the type element 28*b* is allowed to contact with the sheet surface just in the same way as in normal printing. Ink from the print ribbon 27*a* can be firmly set on the right area of the character 41*b* printed by the type element 23*b* in the second print position $P_2$. The bold-faced character thus printed in accordance with the embodiment is free from smudging.

In the foregoing description, the character "I" has been taken as an example to explain the printing operation for the bold-faced character. In this example, the type element 23*b* operated in the second print position $P_2$ does not overlap any part of the dent 42 formed in the first print position $P_1$, with the predetermined distance (d) left between these two positions. The character 'I' consists mostly of a segment transversal to the movement of the type element 23*b*. In some other cases, including 'A' and 'B'; the characters may consist of several character segments which may or may not be disposed transversely to the movement of type element 23*b*. Therefore, in the second position $P_2$ the type element may at least partially overlap a different character segment of the character printed at a first position $P_1$, however, the element will not overlap the same character segment, thus preventing smudging.

The arrangements between the first and second print positions $P_1$ and $P_2$ along the print line may be determined in relation to the center of gravity of the print hammer 25. In this embodiment, the second print position $P_2$ is set to be located rightward of the first print position $P_1$ along the print line, since the print hammer 25 has a leftwardly biased center of gravity. If the center of gravity of the print hammer 25 is biased to the right, the second print position $P_2$ should be located leftward of the first print position $P_1$ to provide the same effect as mentioned before. In case the center of gravity is in center with no biasing, the second print position $P_2$ may be either rightward or leftward of the first print position $P_1$.

While in the embodiment described, the type element 23*b* of the daisy wheel 23 is of the type being hammered by the print hammer 25, the invention will not limited to the print head of this type and can be embodied by, for instance a wire-dot type print head. Further modifications and variations of the invention may be made without departing from the spirits and scope thereof as defined in the appended claims.

What is claimed is:

1. A printing device with bold face printing capability comprising:

input means for inputting character data;

print mode changing means for changing print modes between a normal print mode for printing a character in its original type and a bold-face print mode for printing a character in a bold-face type, said character including a plurality of character segments;

a print head for printing characters on a print sheet in response to said character data, said print head being provided with a print hammer, an eccentric hammer weight attached to said print hammer offsetting the center of gravity of said print hammer, in a first horizontal direction, said print hammer being arranged to be twisted away from said first horizontal direction when a printing operation is executed;

print head driving means for reciprocating said print head along a print line on the print sheet; and control means being operable to control said print head driving means such that, when the bold-face print mode is designated by said print mode changing means, a specific character designated by said input means is printed by said print head sequentially at least at a first, second and third print position disposed along the print line, said second print position being disposed in a second direction opposite said first direction apart from said first print position when a second dint formed in said second print position which is not overlapped with a corresponding character segment of a first dint formed in said first print position so as to form an unprinted area between said first and said second dints, and said third print position located between said first and second print positions to form a third dint to fill said unprinted area of the print sheet between said first and second dints.

2. The printing devise according to claim 1 wherein said third print position is located just in the middle of said first and second print positions

3. The printing devise according to claim 1 wherein said control means is so operated that said print head is moved forward along the print line from said first print position to said second print position, and then moved backward along the print line from said second print position to said third print position.

4. The printing device accordingly to claim 1 wherein said first horizontal direction is a left direction about the center of gravity of said print head.

* * * * *